US009185996B2

(12) United States Patent
Brundick et al.

(10) Patent No.: US 9,185,996 B2
(45) Date of Patent: Nov. 17, 2015

(54) EXPANDABLE GRAVITY-FEED BIN

(71) Applicant: Trade Fixtures, LLC, Little Rock, AR (US)

(72) Inventors: Ronald Brundick, Roland, AR (US); Scott Johnson, Little Rock, AR (US); John Clayton Odom, Benton, AR (US)

(73) Assignee: TRADE FIXTURES, LLC, Little Rock, AR (US)

( * ) Notice: Subject to any disclaimer, the term of this patent is extended or adjusted under 35 U.S.C. 154(b) by 83 days.

(21) Appl. No.: 14/148,396

(22) Filed: Jan. 6, 2014

(65) Prior Publication Data

US 2014/0190987 A1 Jul. 10, 2014

Related U.S. Application Data

(60) Provisional application No. 61/749,311, filed on Jan. 5, 2013.

(51) Int. Cl.
*B67D 7/06* (2010.01)
*A47F 1/08* (2006.01)

(52) U.S. Cl.
CPC ..... *A47F 1/08* (2013.01)

(58) Field of Classification Search
CPC ..... B65G 65/40; A47F 1/03; B65D 47/26; B65D 47/20; B65D 88/66; F16L 25/0009; F16L 39/005; F16L 47/08; F16L 47/10; F16L 47/065
USPC ..... 222/185.1, 566, 226, 143, 1, 544, 231, 222/236, 241, 240, 235, 242, 238, 233, 222/153.13, 196.1, 243, 181.1; 206/503, 206/509, 508; 277/314, 608
See application file for complete search history.

(56) References Cited

U.S. PATENT DOCUMENTS 557,274 A 3/1896 Kade
670,792 A 3/1901 Lippincott
(Continued)

FOREIGN PATENT DOCUMENTS

FR 1309970 A 3/1963
GB 2137602 A 10/1984
(Continued)

OTHER PUBLICATIONS

International Search Report, Patent Cooperation Treaty Application No. PCT/US2006/060428, Mailed Sep. 28, 2007.
(Continued)

*Primary Examiner* — Patrick M Buechner
(74) *Attorney, Agent, or Firm* — James R. Eley; Eley Law Firm Co., LPA

(57) ABSTRACT

A gravity-feed bin includes a generally hollow main bin that has a storage reservoir and an open end. A first generally hollow extension section is selectably coupled to the open end of the main bin. The first extension section is in communication with the reservoir, and the storage capacity of the reservoir is increased by the first extension section. In some embodiments a seal element is intermediate the open end of the main bin and the first extension section, the seal element providing a substantially air-tight seal between the main bin and the first extension section. A plurality of extension sections and seal elements may be selectably coupled together in a stacked arrangement upon the main bin to increase the storage capacity of the reservoir.

18 Claims, 15 Drawing Sheets

(56) References Cited

U.S. PATENT DOCUMENTS

| | | | | |
|---|---|---|---|---|
| 1,184,379 | A | 5/1916 | Ritter | |
| 1,224,136 | A | 5/1917 | Caskey | |
| 1,225,797 | A | 5/1917 | Gardner | |
| 1,317,274 | A | 9/1919 | Dierkes | |
| 1,771,545 | A | 7/1930 | Melvin | |
| 1,931,908 | A | 10/1933 | Tillotson | |
| 2,122,216 | A | 6/1938 | Seawell | |
| 2,326,414 | A * | 8/1943 | Thompson | 220/4.27 |
| 2,360,159 | A * | 10/1944 | Peck | F16L 25/0009 285/371 |
| 2,410,410 | A | 11/1946 | Garubo | |
| 2,527,749 | A | 10/1950 | Lundeen | |
| 2,551,765 | A | 5/1951 | Sedor | |
| 3,138,297 | A | 6/1964 | McKinney | |
| 3,263,870 | A | 8/1966 | Hesford | |
| 3,317,087 | A * | 5/1967 | Landis | 222/143 |
| 3,512,805 | A * | 5/1970 | Glatz | F16L 9/003 138/166 |
| 3,666,150 | A | 5/1972 | Liljeholm | |
| 3,680,566 | A | 8/1972 | Tanaka et al. | |
| 3,836,181 | A * | 9/1974 | Kelver | F16L 25/0009 285/424 |
| 3,885,672 | A | 5/1975 | Westenrieder | |
| 3,997,072 | A | 12/1976 | Guth | |
| 4,212,415 | A | 7/1980 | Neely | |
| 4,298,038 | A | 11/1981 | Jennings | |
| 4,318,577 | A | 3/1982 | Vona | |
| 4,349,128 | A | 9/1982 | Sanfilippo | |
| 4,474,303 | A | 10/1984 | Maccise | |
| 4,538,837 | A * | 9/1985 | Cronk | F16L 25/14 285/148.11 |
| 4,562,941 | A | 1/1986 | Sanfilippo | |
| 4,592,494 | A | 6/1986 | Ellis et al. | |
| 4,619,379 | A | 10/1986 | Biehl | |
| D286,728 | S | 11/1986 | Elmore | |
| 4,650,098 | A * | 3/1987 | Ellis et al. | 222/252 |
| 4,683,674 | A | 8/1987 | Faul | |
| 4,718,578 | A | 1/1988 | Radek et al. | |
| 4,802,609 | A | 2/1989 | Morse et al. | |
| 4,889,263 | A * | 12/1989 | Ellis et al. | 222/185.1 |
| 4,903,866 | A | 2/1990 | Loew | |
| 4,984,690 | A | 1/1991 | King et al. | |
| 5,026,129 | A | 6/1991 | Merl | |
| 5,039,137 | A * | 8/1991 | Cankovic | F16L 25/14 285/148.26 |
| 5,092,498 | A | 3/1992 | Willems et al. | |
| 5,105,991 | A | 4/1992 | Johnson | |
| D326,983 | S | 6/1992 | Elmore | |
| 5,180,069 | A | 1/1993 | Krummell | |
| 5,217,507 | A | 6/1993 | Spirig | |
| 5,308,158 | A | 5/1994 | Vogelsong et al. | |
| 5,437,393 | A | 8/1995 | Blicher et al. | |
| 5,441,321 | A | 8/1995 | Karpisek | |
| 5,469,992 | A | 11/1995 | Jenkins | |
| 5,474,195 | A | 12/1995 | Pai | |
| 5,505,497 | A * | 4/1996 | Shea | F16L 21/005 24/271 |
| 5,549,228 | A | 8/1996 | Brown | |
| 5,551,604 | A | 9/1996 | Kern et al. | |
| 5,560,519 | A | 10/1996 | Moore et al. | |
| 5,626,250 | A | 5/1997 | Dorazio | |
| D379,884 | S | 6/1997 | Eastman | |
| 5,826,754 | A | 10/1998 | Ishaya et al. | |
| 5,836,480 | A | 11/1998 | Epp et al. | |
| 5,839,587 | A | 11/1998 | Gress et al. | |
| D413,767 | S | 9/1999 | Elmore | |
| D414,078 | S | 9/1999 | Elmore | |
| 6,029,859 | A | 2/2000 | Robbins, III | |
| 6,082,591 | A | 7/2000 | Healey | |
| 6,142,301 | A | 11/2000 | Lin et al. | |
| 6,182,864 | B1 | 2/2001 | Elmore | |
| 6,220,313 | B1 | 4/2001 | Estlander | |
| D441,530 | S | 5/2001 | Elmore | |
| 6,241,123 | B1 | 6/2001 | Elmore | |
| 6,276,547 | B1 | 8/2001 | Petryna | |
| D469,661 | S | 2/2003 | Rivkin | |
| D470,016 | S | 2/2003 | Rivkin | |
| D470,363 | S | 2/2003 | Rivkin | |
| D471,407 | S | 3/2003 | Rivkin | |
| 6,571,990 | B2 | 6/2003 | Bird | |
| 6,908,004 | B2 | 6/2005 | Barr | |
| 7,093,715 | B1 | 8/2006 | Apps | |
| 7,128,230 | B2 | 10/2006 | Jacobson et al. | |
| 7,178,697 | B2 | 2/2007 | Brundick | |
| 7,488,010 | B2 * | 2/2009 | Wellman | F16L 23/032 285/363 |
| 7,510,096 | B2 | 3/2009 | Wang | |
| 7,562,784 | B2 | 7/2009 | Stevenson | |
| 7,832,598 | B2 | 11/2010 | Rode et al. | |
| 7,975,866 | B2 | 7/2011 | Peterman et al. | |
| 8,245,452 | B2 | 8/2012 | Koteskey | |
| 2006/0186138 | A1 | 8/2006 | Brundick | |
| 2006/0191958 | A1 | 8/2006 | Brundick | |
| 2007/0131681 | A1 | 6/2007 | Pawlowski | |
| 2007/0138176 | A1 | 6/2007 | Gawlick | |
| 2009/0120930 | A1 | 5/2009 | Sexton | |
| 2011/0062187 | A1 | 3/2011 | Johnson | |
| 2011/0062190 | A1 | 3/2011 | Johnson | |
| 2011/0248040 | A1 | 10/2011 | Mcgregor | |

FOREIGN PATENT DOCUMENTS

| | | | |
|---|---|---|---|
| WO | 9842240 | A1 | 10/1998 |
| WO | 0162127 | A2 | 8/2001 |
| WO | 2004097697 | A1 | 11/2004 |

OTHER PUBLICATIONS

International Search Report, Patent Cooperation Treaty Application No. PCT/US2001/006162, Mailed Aug. 28, 2001.

P.I.C. Bulk Dispenser Product Flyer, Puckerpowder, Creative Concepts, Irondale, AL, May 2013, www.puckerpowder.com.

Product Catalog, NewLeaf Designs, 1997, pp. 4-7, Vita-Bin(R) bin systems.

Product literature, Bestbins Corporation, 4 gal. and 8 gal. gravity feed bins with assembly instructions.

Product literature, Trade Fixtures NewLeaf Designs, gravity and scoop feed bins, May 10, 2004, http:/www.tradefixtures.com/bins/newleaf.htm.

International Search Report, Patent Cooperation Treaty Application No. PCT/US2014/010368, Mailed May 12, 2014.

* cited by examiner

EXPANDABLE GRAVITY-FEED BIN

This application claims priority to U.S. provisional application 61/749,311, filed Jan. 5, 2013, the contents of which are hereby incorporated by reference.

FIELD

The present invention relates generally to a bulk-product inventory dispensing apparatus and, more particularly, to a gravity-feed dispensing apparatus with an expandable reservoir.

BACKGROUND

Gravity-feed bins for dispensing bulk-product inventory are used to dispense a wide variety of materials having a range of sizes and aggregate make-ups as diverse as hardware components, for example, nuts and bolts, to retail grocery food, such as pastas, cereals, nuts, coffee (either beans or ground), dried soup mixes, candies, spices, and the like. Generally, a gravity-feed bin is comprised of a hollow hopper-type reservoir enclosure having an inlet at an upper end utilized to fill the enclosure with bulk inventory, an outlet or chute at its lower end utilized to dispense the material, and a flow-control device located intermediate the upper and lower openings and controlled by a manually-actuated gate mechanism. This arrangement, in turn permits manipulation of the amount of inventory being dispensed during the interval the handle or other control device is actuated. In operation, as the inventory is being dispensed, the force of gravity causes the portion stored above in the reservoir to progressively migrate towards the lower end to replace the void left as portions of the inventory are dispensed. These types of bins generally include a downwardly angled or curving floor within the cavity that forms a slide to channel the stored inventory into a receptacle downstream from the outlet gate.

An alternate means for dispensing stored bulk inventory is to employ a bulk food dispenser generally known as a "scoop bin." As the name suggests, a scoop bin typically comprises a hollow plastic bin, often having a hinged lid that is lifted to provide the consumer access to the stored contents. A hand scoop is then employed to gather the bulk product for placement into a container. While scoop bins are effective for dispensing a wider variety of product than a gravity type dispenser, they suffer from several major disadvantages, particularly in the area of hygiene, because of the contamination that can take place in these types of dispensers. Sources of contamination include germs that may be attached to the scoop or scoop handle being transferred to the stored product during dispensing or from external debris falling into the bin cavity when the bin's lid is lifted. Lastly, since the nature of scoop bins requires their openings to be located closer to the floor for access reasons, they are generally within the reach of children and others who are not hesitant to reach into the unsecured bins with potentially unclean hands in order to extract a sample, or even play with the bin contents. In addition, scoop bins also suffer from inventory shrinkage, both from pilferage and from accidental spillage.

As can be appreciated from the foregoing discussion, gravity-feed bins offer a multitude of advantages compared to other dispensing means, such as scoop bins, including convenience, ease of use and hygiene. Heretofore, gravity-feed bins have been provided with a reservoir having one of several fixed capacities. This limits the quantity of bulk inventory that is available for dispensing, particularly if the bulk inventory to be dispensed is relatively large or is a popular item. As a result, such inventory may be rapidly depleted. There is a need for a way to conveniently and cost-effectively match the storage capacity of a gravity-feed bin to the type of material being dispensed, and to the level of demand for the product.

SUMMARY

An expandable sectional gravity-feed bin is disclosed according to several embodiments of the present invention. The bin comprises a main bin having a storage reservoir and a dispensing chute. An upper spout is coupled to dispensing chute, and a lower spout is coupled to the upper spout. A handle includes a dispensing gate that selectably closes off an opening in the upper spout. The bin may further include one or more extension sections that are selectably attachable to an open end of the main bin to increase the storage capacity of the reservoir.

In one aspect of the present invention a gravity-feed bin includes a generally hollow main bin that has a storage reservoir and an open end. A first generally hollow extension section is selectably coupled to the open end of the main bin. The first extension section is in communication with the reservoir, and the storage capacity of the reservoir is increased by the first extension section. In some embodiments a seal element is located intermediate the open end of the main bin and the first extension section, the seal element providing a substantially air-tight seal between the main bin and the first extension section. A plurality of extension sections and seal elements may be selectably coupled together in a stacked arrangement upon the first extension section and/or the main bin to further increase the storage capacity of the reservoir.

In another aspect of the present invention a gravity-feed bin comprises a generally hollow main bin that includes a storage reservoir and an open end. The gravity-feed bin further includes a plurality of generally hollow extension sections, each of the plurality of extension sections being configured to be selectably coupled to an immediately adjacent extension section, and a select one of the plurality of extension sections being configured to be selectably coupled to the open end of the main bin. The plurality of extension sections are in communication with the reservoir and form a stacked arrangement having a cumulative volume corresponding to the sum of the extension sections. The gravity-feed bin further includes a plurality of seal elements, a seal element located intermediate each of the immediately adjacent extension sections and a select seal element being intermediate the main bin and the select one of the plurality of extension sections immediately adjacent to the main bin. The storage capacity of the reservoir is selectively increased by the sum of the plurality of extension sections. Furthermore, the plurality of seal elements provide a substantially air-tight seal between the immediately adjacent extension sections.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
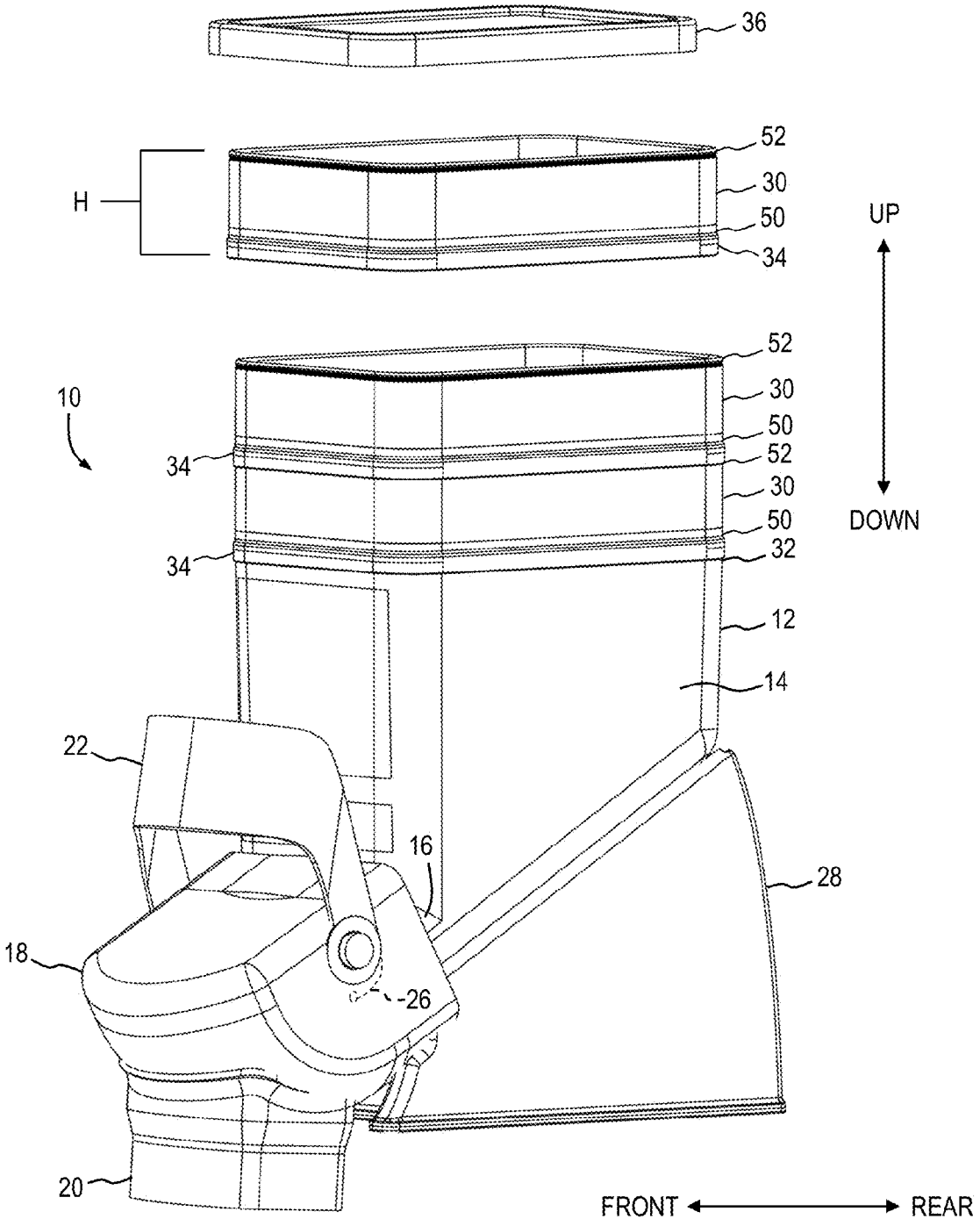
FIG. 1 is an exploded view showing the general arrangement of an expandable gravity-feed bin according to an embodiment of the present invention.
Figure 2:
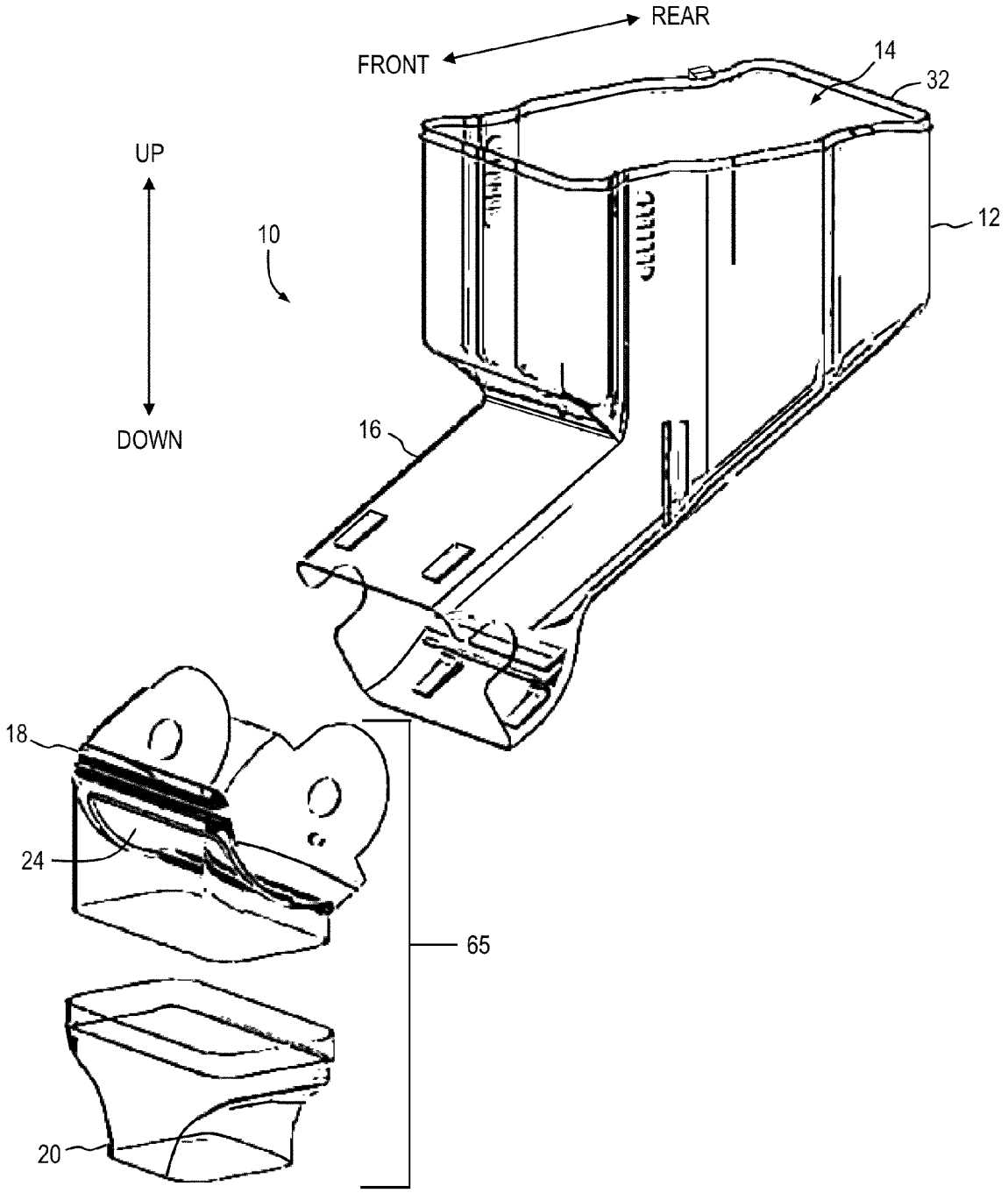
FIG. 2 is an exploded view showing certain components of the bin of FIG. 1.

The general arrangement of a selectably expandable gravity-feed bin 10 is shown in FIGS. 1 and 2 according to an embodiment of the present invention. Bin 10 comprises a generally hollow main bin 12 having a storage reservoir 14 and a generally hollow dispensing chute 16. A generally hollow spout may be in communication with reservoir 14. For example, in the bin 10 of FIGS. 1 and 2 a generally hollow upper spout 18 is coupled to dispensing chute 16, and a generally hollow lower spout 20 is coupled to the upper spout. A handle 22 is coupled to a dispensing gate 23 (FIG. 11) that selectably closes off an opening 24 in upper spout 18. A biasing element 26 coupled to handle 22 urges the handle and dispensing gate 23 into a closed position with the dispensing gate substantially closing off opening 24. A selectably removable cover 27 (FIGS. 10, 13) may optionally be used to at least substantially enclose biasing element 26. Main bin 12 may be attached to a base 28, or may be attached to a not-shown display rack, shelf or table.

Biasing element 26 may be any suitable component (or components) for urging and maintaining handle 22 and dispensing gate 23 in the closed position when not in use. As non-limiting examples biasing element 26 may be made from natural or synthetic rubber, or other elastic material. Biasing element 26 may also be one or more springs. Example spring types may include, without limitation, a tension spring, compression spring and torsion spring. The spring may be formed in any convenient shape, such as a helical coil spring, flat spring and leaf spring, among others. The spring may be made from any suitable materials including, without limitation, metal, plastic and composites.

To operate bin 10 a user grasps handle 22 and moves the handle against the bias exerted by biasing element 26, causing dispensing gate 23 to move away from opening 24. Product stored in reservoir 14 of bin 10, such as bulk materials, is urged downwardly by gravity and is dispensed through dispensing chute 16, opening 24, upper spout 18 and lower spout 20. When a desired amount of material has been dispensed the user releases handle 22, thereby urging the handle back to the closed position, with dispensing gate 23 again closing off opening 24.

In a first embodiment of the present invention bin 10 may further include one or more generally hollow extension sections 30. As shown generally in FIG. 1, a first extension section 30 is selectably coupled to an open end 32 of main bin 12 and is in communication with reservoir 14 to increase the storage capacity of the reservoir. Preferably, a seal element 34 is located intermediate open end 32 of main bin 12 and an adjacent extension section 30.

In some embodiments of the present invention a plurality of extension sections 30 may be selectably coupled to main bin 12 in a stacked arrangement. In this arrangement a second extension section 30 is selectably coupled to the first extension section, a third extension section is selectably coupled to the second extension section, and so on to increase the storage capacity of reservoir 14 by a desired amount. Preferably, a seal element 34 is provided intermediate each immediately adjacent extension sections 30. Seal element 34 preferably provides a substantially air-tight seal between adjoining elements.

A sealing lid 36 selectably engages the uppermost extension section 30 and substantially closes off the second end 52 of the uppermost extension section. Preferably, sealing lid 36 also provides a substantially air-tight seal of the uppermost extension section 30.

Extension sections 30 may be any suitable dimensions. As non-limiting examples, in various configurations the extension sections 30 may have a height "H" (FIG. 1) of about 2 inches or about 3 inches, though greater and lesser height dimensions are envisioned within the scope of the invention. Extension sections 30 may be of the same height or of varying heights in a stackup of extension sections.

Figure 3:
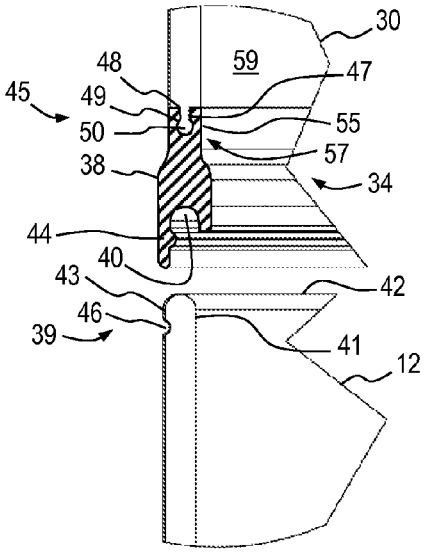
FIG. 3 is a partial view in section showing details of a sealing element of the bin of FIG. 1.

With continued reference to FIG. 1, details of an example seal element 34 are shown in FIG. 3 according to an embodiment of the present invention. Seal element 34 includes a seal body 38. A first, generally U-shaped receptacle 40 is configured to receive a first edged perimeter 39, such as an edge 42 of main bin 12. Edge 42 includes a first interior surface 41 and an opposing first exterior surface 43. Seal element 34 may further include one or more lips 44 that are adapted to engage a corresponding groove or slot (hereafter generally "groove") 46 of the first exterior surface 43 of edge 42 of main bin 12. An opposing, second receptacle 48 of seal element 34 is generally keyhole-shaped to correspond to the shape of a second edged perimeter 45, such as a first edge 50 of extension section 30. First edge 50 includes a second interior surface 47 and an opposing second exterior surface 49. A third edged perimeter 51, such as second, opposing edge 52 of extension section 30 may be shaped similar to edge 42 of main bin 12. Second edge 52 includes a third interior surface 31 and an opposing third exterior surface 33. Seal element 34 is disposed intermediate to and configured to sealingly engage the first interior surface 41 and the first exterior surface 43 of the first edged perimeter 39 and the second interior surface 47 and the second exterior surface 49 of the second edged perimeter 45. Upon engagement seal 34 provides a substantially airtight seal between main bin 12 and first extension section 30. Furthermore, an upper portion 55 of an interior side 57 of seal element 34 is also configured to be assembled substantially flush with an interior side 59 of the first extension section 30.

Figure 4:
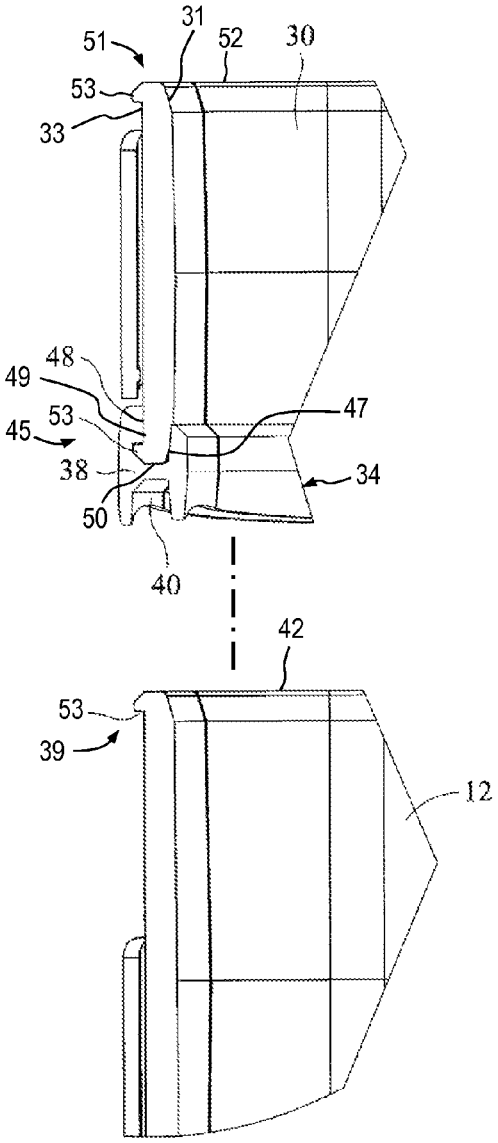
FIG. 4 is a partial view in section showing details of a sealing element of the bin of FIG. 1 according to an alternate embodiment of the present invention.

It should be noted that the shape of seal element 34 may be varied as desired to conform to edges 42, 50 and 52. Furthermore, edges 42, 50 and 52 may be varied in shape as desired to suit a particular bin 10. For example, a seal element 34 according to an alternate embodiment is shown in FIG. 4. In this embodiment seal element 34 includes a first receptacle 40 that is shaped to receive edge 42 of main bin 12 and/or second edge 52 of an extension section 30. Likewise, a second, opposing receptacle 48 is shaped to receive a first edge 50 of an extension section 30. Furthermore, any or all of edges 42, 50 and 52 may be shaped to include a flanged portion 53 corresponding to the shape of receptacles 40, 48.

In some embodiments seal element 34 is a separate component that is coupled to main bin 12 and extension sections 30. In other embodiments seal element 34 may be made integral with either or both of main bin 12 and extension sections 30 by any suitable process, such as overmolding. Seal element 34 may be made from any suitable material including, without limitation, plastic and rubber.

Figure 5:
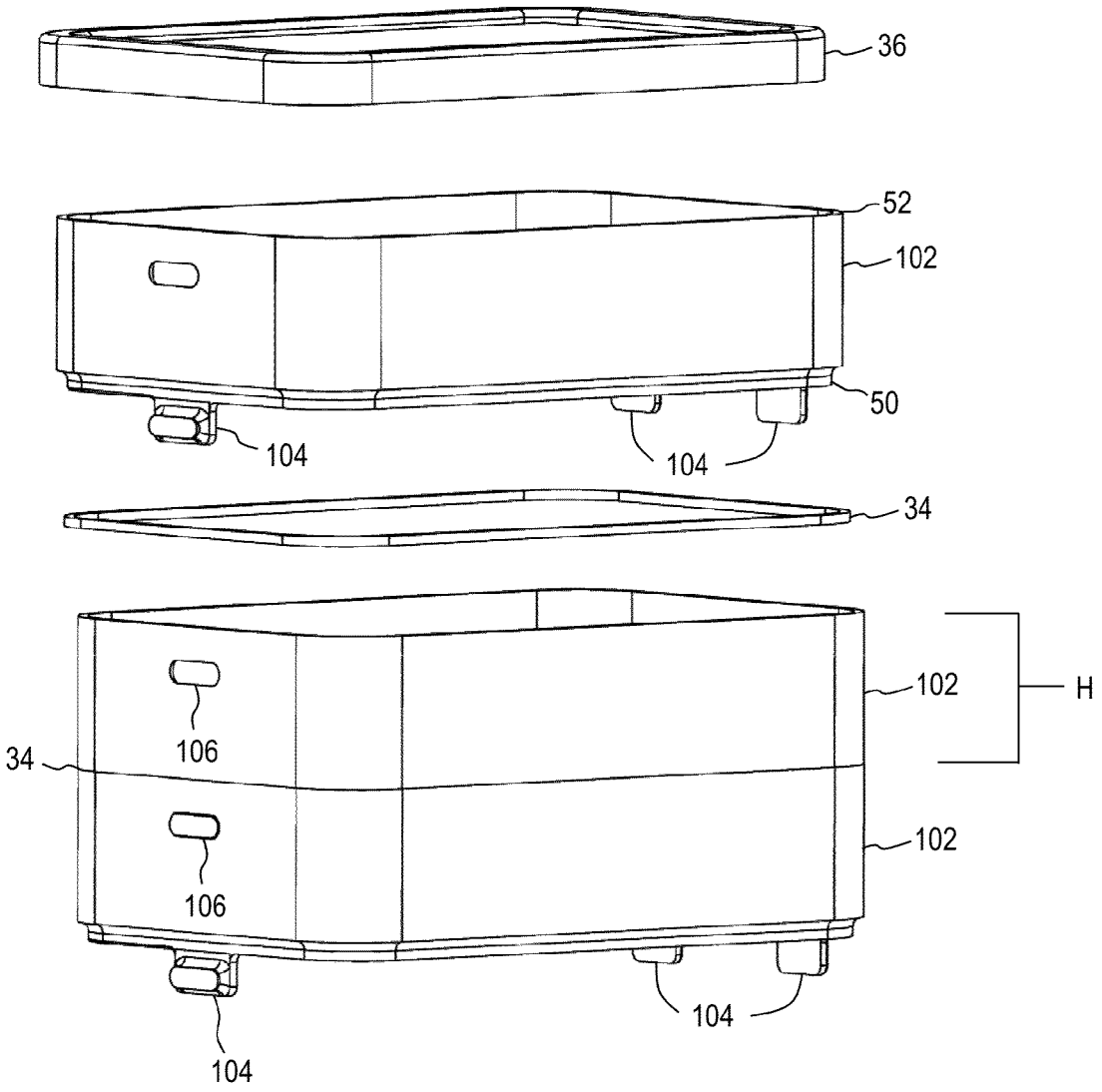
FIG. 5 is an exploded view showing the general arrangement of a plurality of extension sections according to another embodiment of the present invention.
Figure 6:
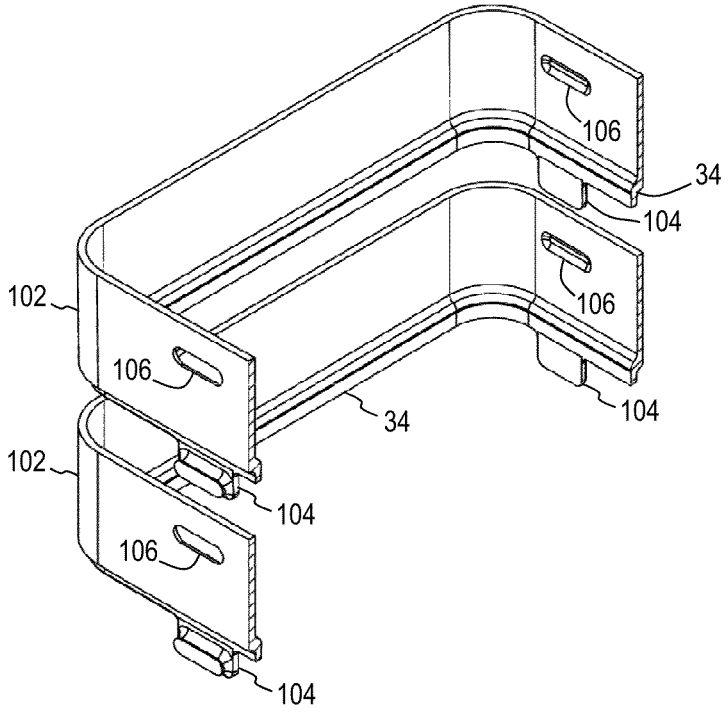
FIG. 6 is an exploded, partial view in section of the extension sections of FIG. 5.

In another embodiment of the present invention, shown in FIGS. 5 and 6, one or more extension sections 102 may be selectably attached to reservoir 14. In this embodiment extension sections 102 each include one or more tabs 104 configured to fit into a mating slot or indentation (hereafter generally "slot") 106 in an adjacent extension section or in main bin 12.

A seal 34 may be arranged intermediate edge 42 of main bin 14 and the immediately adjacent extension section 102. Likewise, a seal 34 may be arranged intermediate immediately adjacent extension sections 102, as shown in FIG. 5.

Extension sections 102 may be any suitable dimensions. As non-limiting examples, in various configurations the extension sections 102 may have a height "H" (FIG. 5) of about 2 inches or about 3 inches, though greater and lesser height dimensions are envisioned within the scope of the invention. Extension sections 102 may be of the same height or of varying heights in a stackup of extension sections.

It is understood that the positions of tabs 104 and mating slots or indentations may be reversed from that shown in the figures within the scope of the invention. For example, tabs 104 may extend from main bin 12 to mate with corresponding slots or indentations in an adjacent extension section 102.

Figure 7:
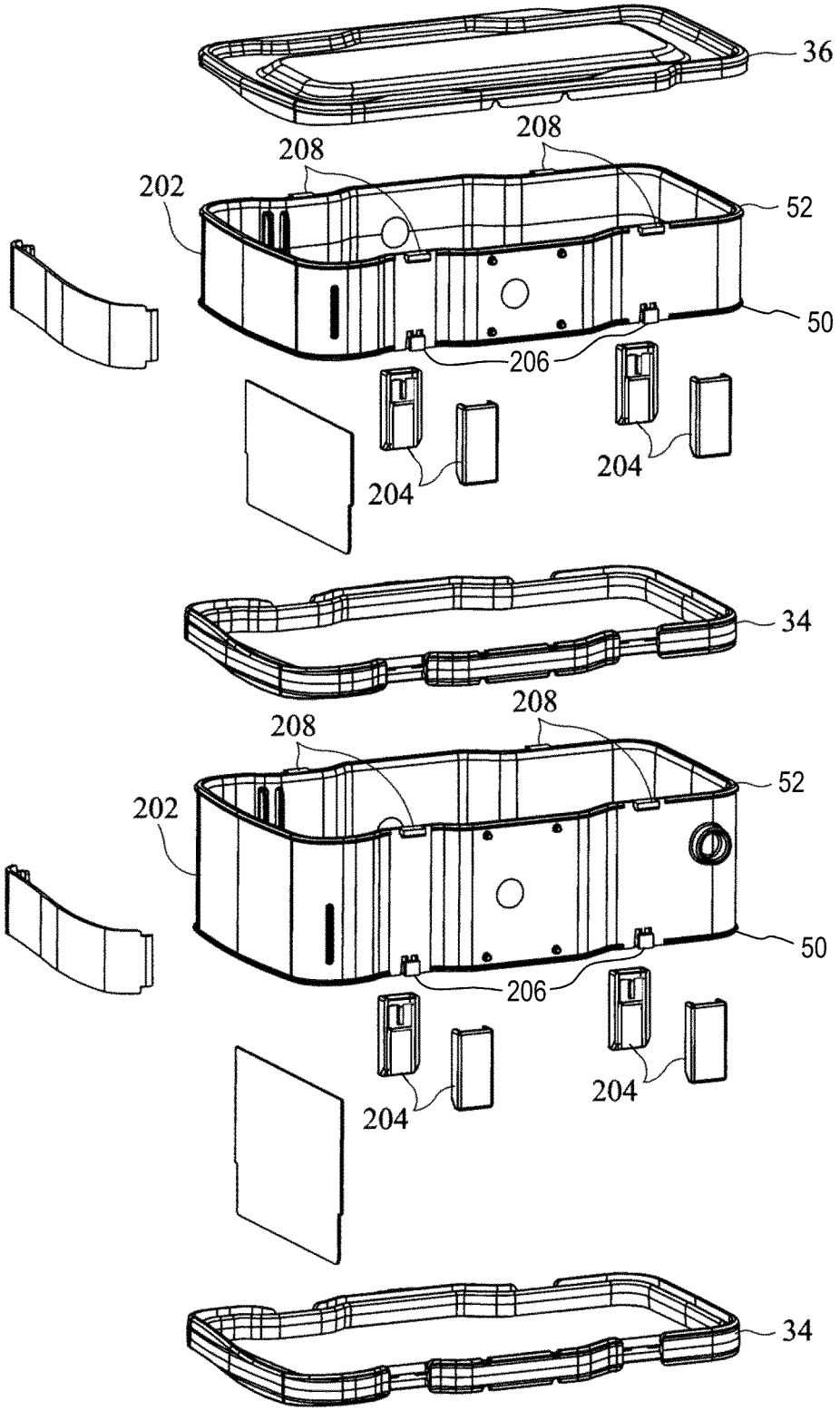
FIG. 7 is an exploded view showing the general arrangement of a plurality of extension sections according to still another embodiment of the present invention.
Figure 8:
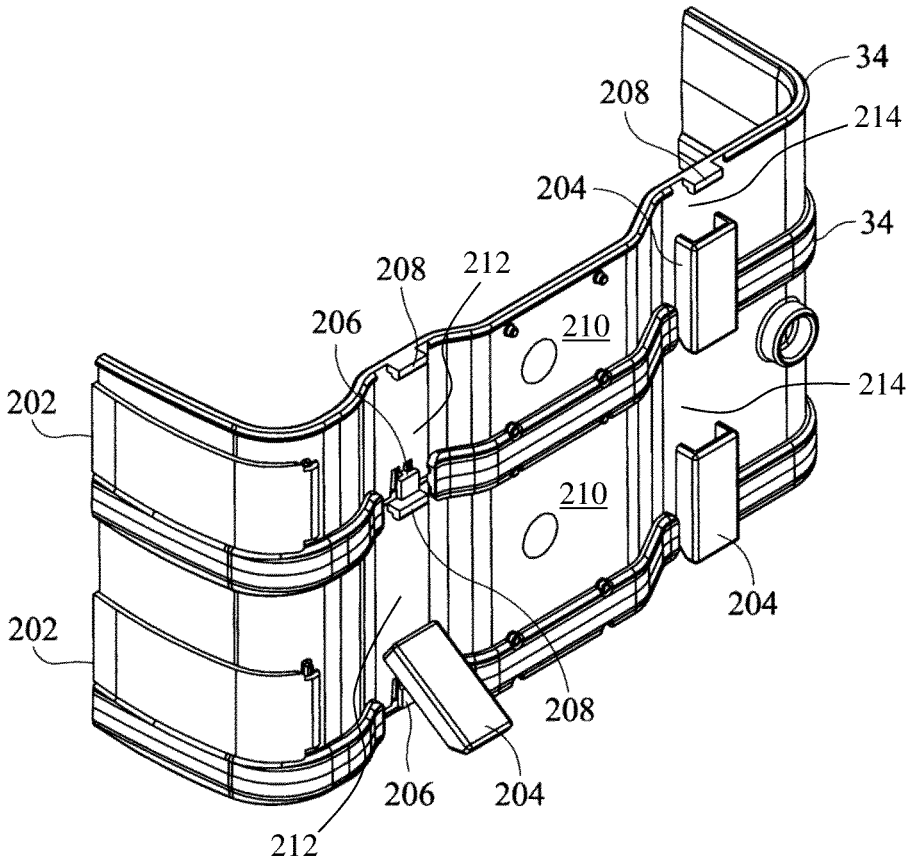
FIG. 8 is a partial view in section of the extension sections of FIG. 7.
Figure 9:
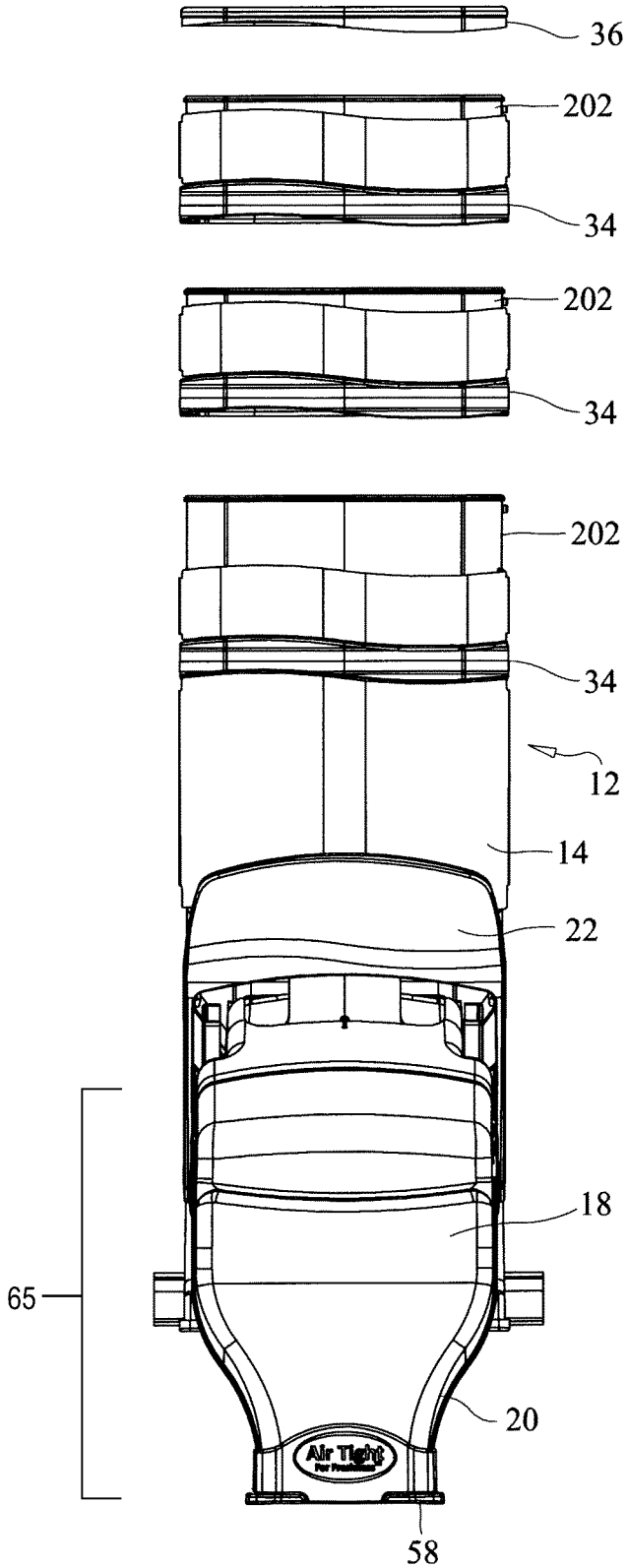
FIG. 9 is a front elevational, exploded view of a gravity-feed bin incorporating the extension sections of FIGS. 7 and 8.

In yet another embodiment of the present invention, shown in FIGS. 7, 8, 9 and 10 one or more extension sections 202 may be selectably attached to reservoir 14. In this embodiment extension sections 202 each include one or more fasteners 204, first protrusions 206 and second protrusions 208. An extension section 202 is selectably coupled to main bin 12 or to an immediately adjacent extension section by locating the extension section upon the main bin (or adjacent extension section, as the case may be) such that corresponding first protrusions 206 and second protrusions 208 are adjacent to one another, as shown in FIG. 8. Fastener 204 is then moved to engage protrusions 206, 208, thereby selectably coupling the extension section 202 to main bin 14 (or to an immediately adjacent extension section). Each of extension sections 202 include a wall 210 having one or more recessed portions 212 and/or offsets 214, which align when adjacent extension sections are coupled together. Similarly, main bin 12 includes a wall 216 having one or more recessed portions 212 and/or offsets 214, which align with those of the adjacent extension section 202 when the main bin and extension section are coupled together. The recessed portions 212 and/or offsets 214 thus allow for a recessed housing of the engaged fasteners 204 such that an exterior surface of fasteners 204 does not protrude substantially past an exterior side of walls 210.

Figure 10:
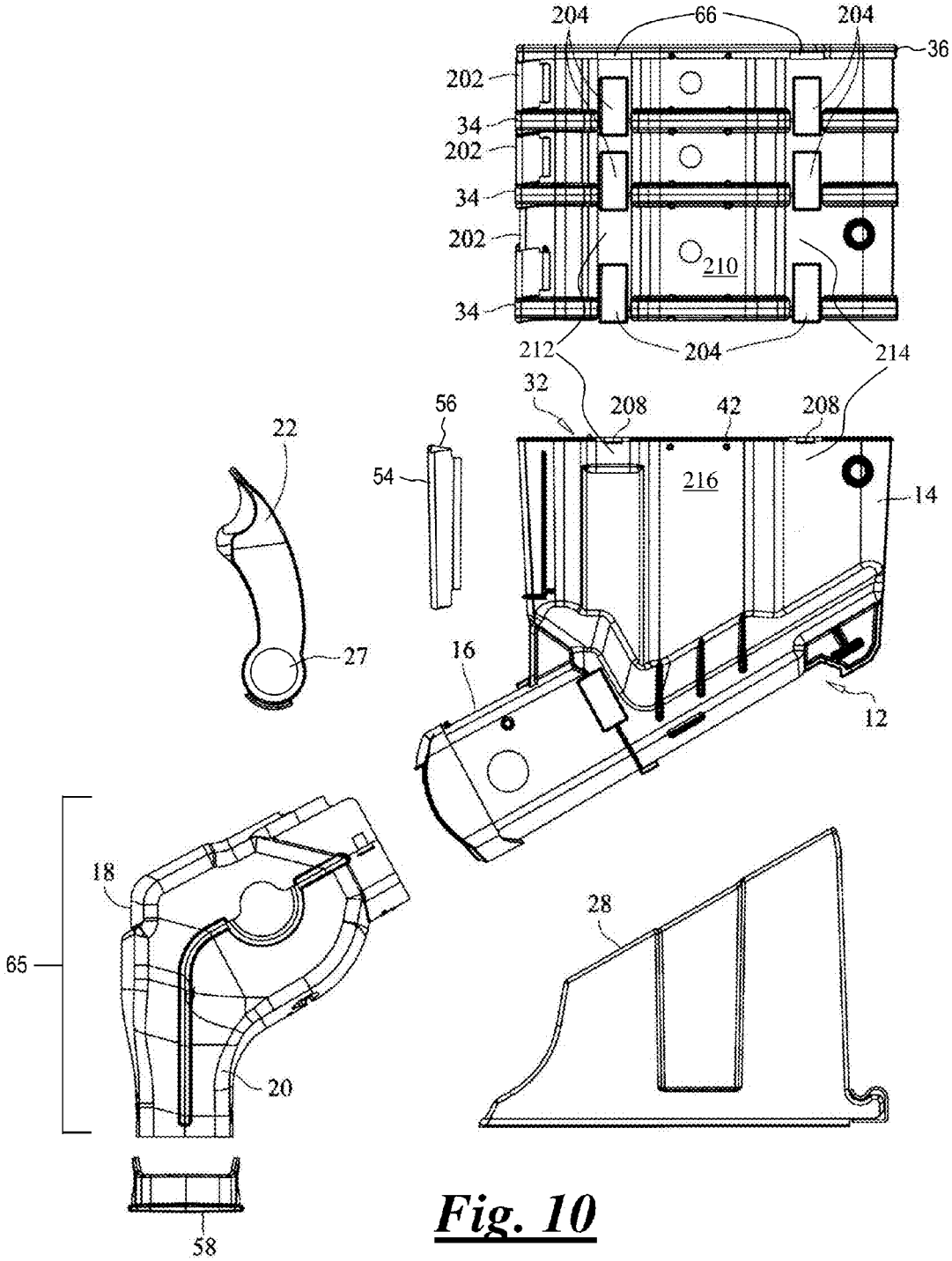
FIG. 10 is a side elevational, exploded view of the gravity-feed bin of FIG. 9.

As shown in FIGS. 7 and 10, a seal 34 may be arranged intermediate edge 42 of main bin 14 and the immediately adjacent extension section 202. Likewise, a seal 34 may be arranged intermediate immediately adjacent extension sections 202.

Extension sections 202 may be any suitable dimensions. As non-limiting examples, in various configurations the extension sections 202 may have a height "H" (FIG. 7) of about 2 inches or about 3 inches, though greater and lesser height dimensions are envisioned within the scope of the invention. Extension sections 202 may be of the same height or of varying heights in a stackup of extension sections.

It is understood that the positions of fasteners 204 and mating protrusions 206, 208 may be reversed from that shown in the figures within the scope of the invention. Furthermore, fasteners 204 may be attached to main bin 12 and/or extension sections 202, or may be separate from the main bin and the extension sections as separate pieces that are attached to protrusions 206, 208.

Figure 11:
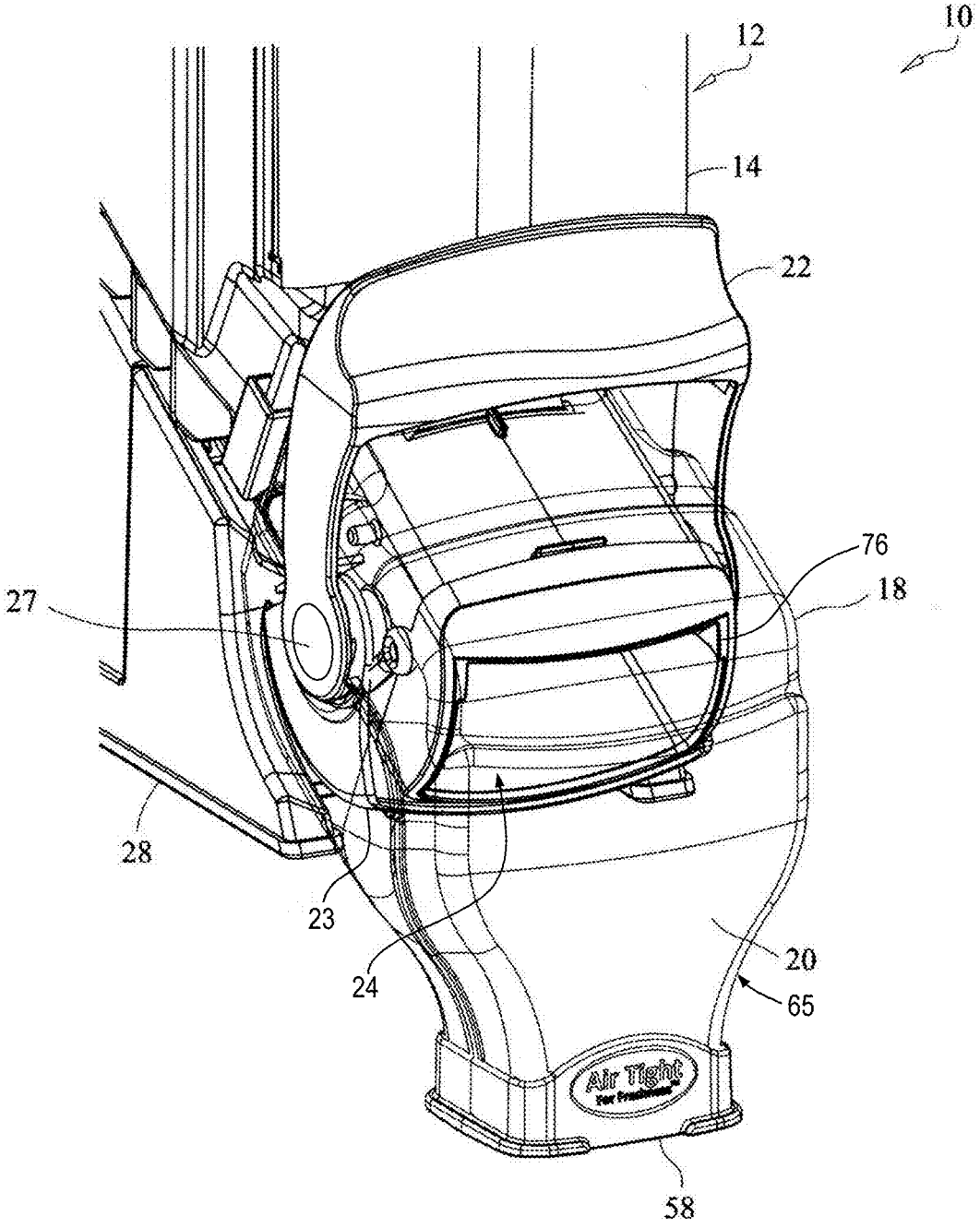
FIG. 11 is a partial perspective view showing further details of the gravity-feed bin of FIG. 9.
Figure 12:
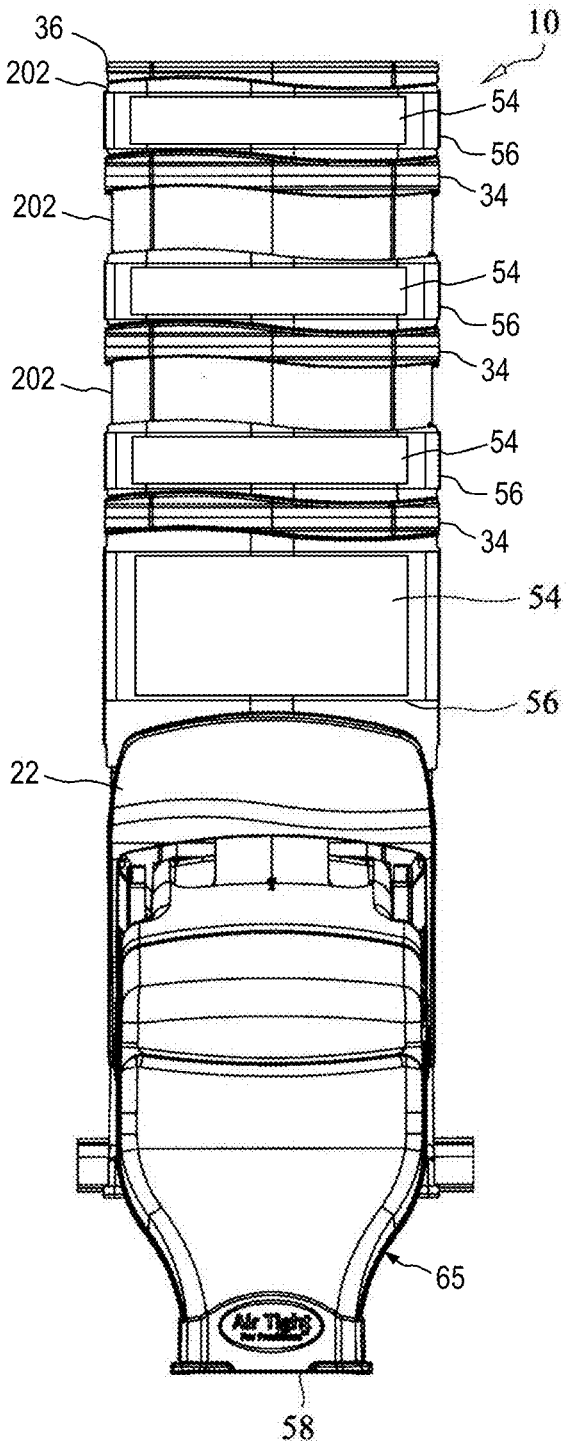
FIG. 12 is a front elevational view of the gravity-feed bin of FIG. 9.
Figure 13:
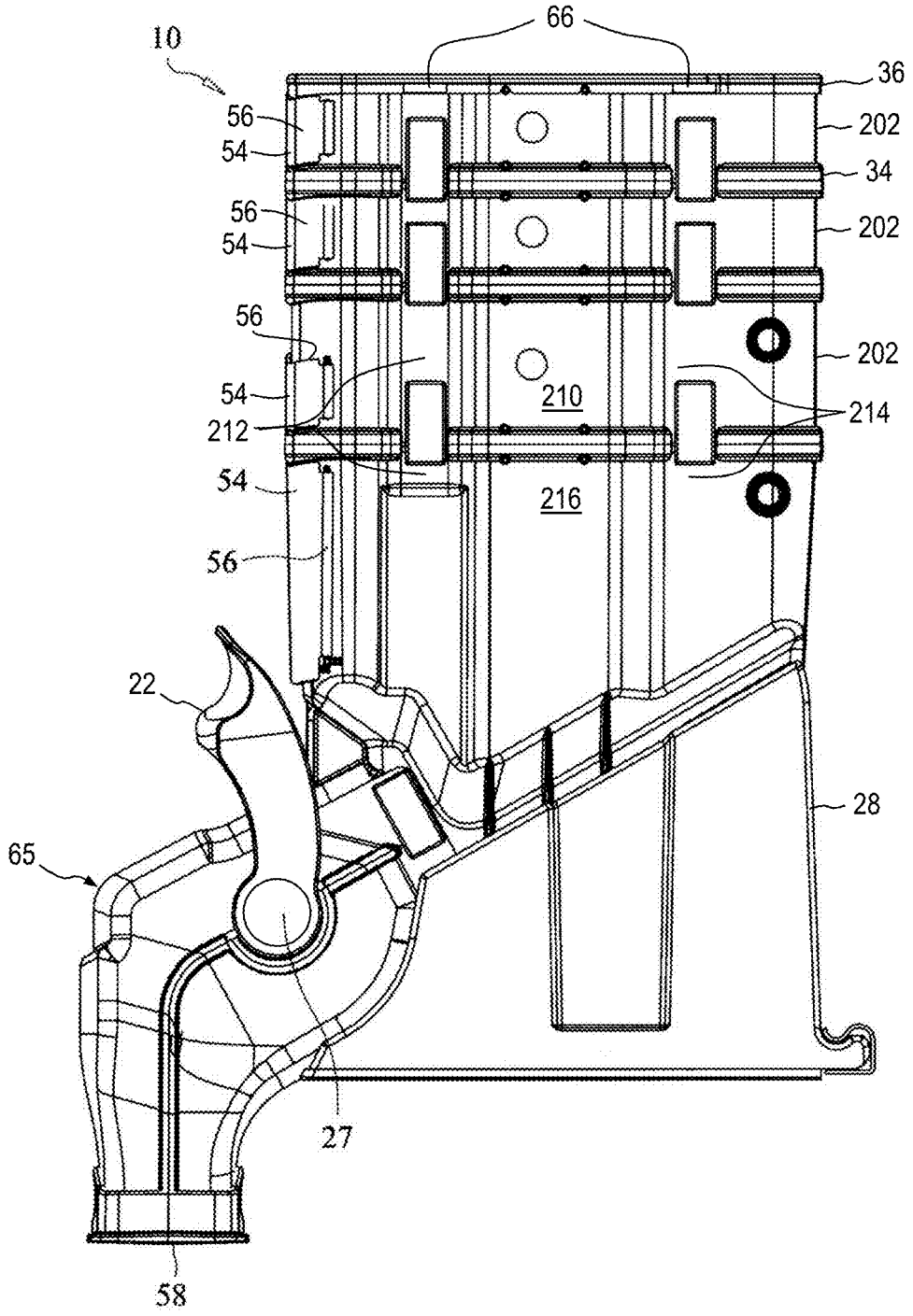
FIG. 13 is a side elevational view of the gravity-feed bin of FIG. 9.

FIGS. 11 through 13 show further details and features of a bin 10. For example, bin 10 may include one or more labels 54 that are selectably or permanently affixed to a label holder 56, as shown in FIGS. 12 and 13. Any or all of extension sections 30, 102, 202 may likewise include one or more labels 54 that are selectably or permanently affixed to a label holder 56, as generally shown in FIGS. 12 and 13. For the sake of clarity FIG. 11 is shown with handle 22 in a "closed" position for dispensing product from bin 10, while gate 23 is shown in an "open" dispensing position.

In addition, lower spout 20 may include a selectably detachable or permanently-attached bag-grip element 58, as shown in FIGS. 12 and 13. In some embodiments bag-grip element 58 is made from a soft or medium durometer material.

Figure 14:
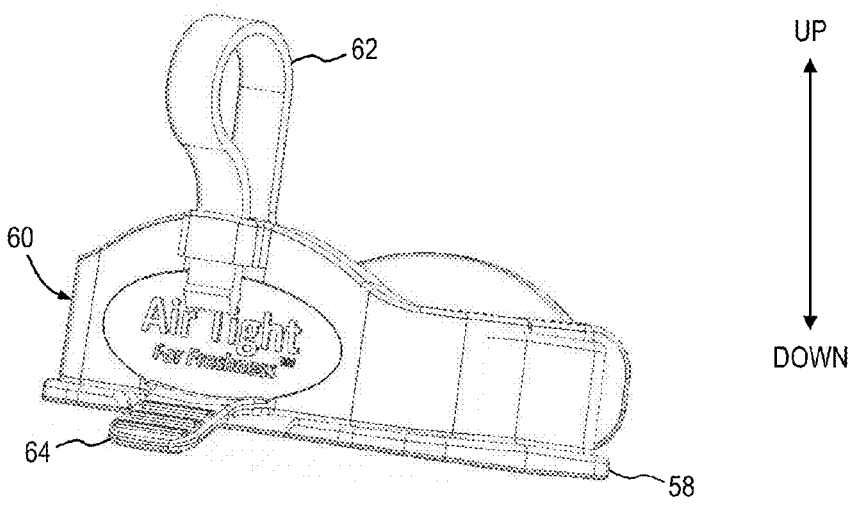
FIG. 14 shows a bag-grip element according to an embodiment of the present invention.
Figure 15:
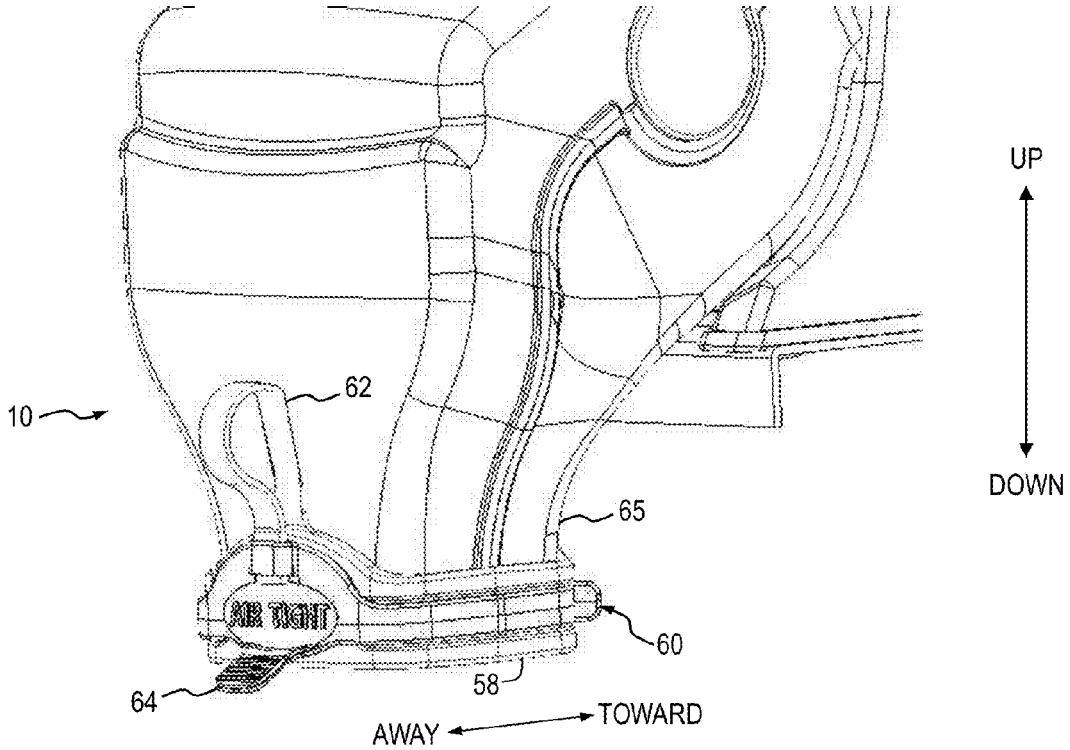
FIG. 15 shows the bag-grip element of FIG. 14 attached to a gravity-feed bin according to an embodiment of the present invention.

With reference to FIGS. 14 and 15, in still further embodiments of the present invention a bag retainer 60 may optionally be utilized in conjunction with a bag-grip element 58. Bag retainer 60 is preferably generally "C"-shaped and is preferably sufficiently flexible to selectably engage bag grip element 58. A strap 62 may optionally be extended between bag grip element 58 and bag retainer 60 to permanently or selectably attach the bag retainer to the bag grip element. Bag retainer 60 may further include a tongue 64 extending therefrom.

In use of bag retainer 60 a user grasps tongue 64 and urges (i.e., pulls) the bag retainer away from bag grip element 58, then places an open end of a not-shown bag over the bag-grip element such that the interior of the bag is in communication with a spout 65 (detailed below) of bin 10. Bag retainer 60 is then urged toward (i.e., against) bag-grip element 58, causing the bag retainer to expand slightly to engage and selectably couple to the bag-grip element, thereby trapping the bag between the bag retainer and the bag grip element. The bag is thus secured to bin 10 and is ready to receive product dispensed from the bin. After a desired amount of product has been dispensed from the bin into the bag and the bag is ready for removal from bin 10 the user grasps tongue 64 and again urges bag retainer 60 away from bag-grip element 58 to release the bag from the bag-grip element.

In some embodiments of the present invention upper spout 18 and lower spout 20 may be a single component, such as a spout 65, shown in FIG. 15. Spout 65 may be formed by assembling or joining together upper spout 18 and lower spout 20. Alternatively, spout 65 may be formed as a single integral, unitary piece.

The various components of bin 10 discussed above may be made from any suitable materials such as, without limitation, plastic, metal, composites and rubber. The components may be produced using any suitable process, such as molding and machining, among others. Some of the components of bin 10 may be opaque and/or translucent or generally clear, as desired. The components may be finished if desired, such as with molded-in colors, paint, plating, or may be left unfinished.

In some embodiments lid 36 may optionally include one or more recesses 66 (FIG. 10) to aid a user in grasping the lid for removal.

Figure 16:
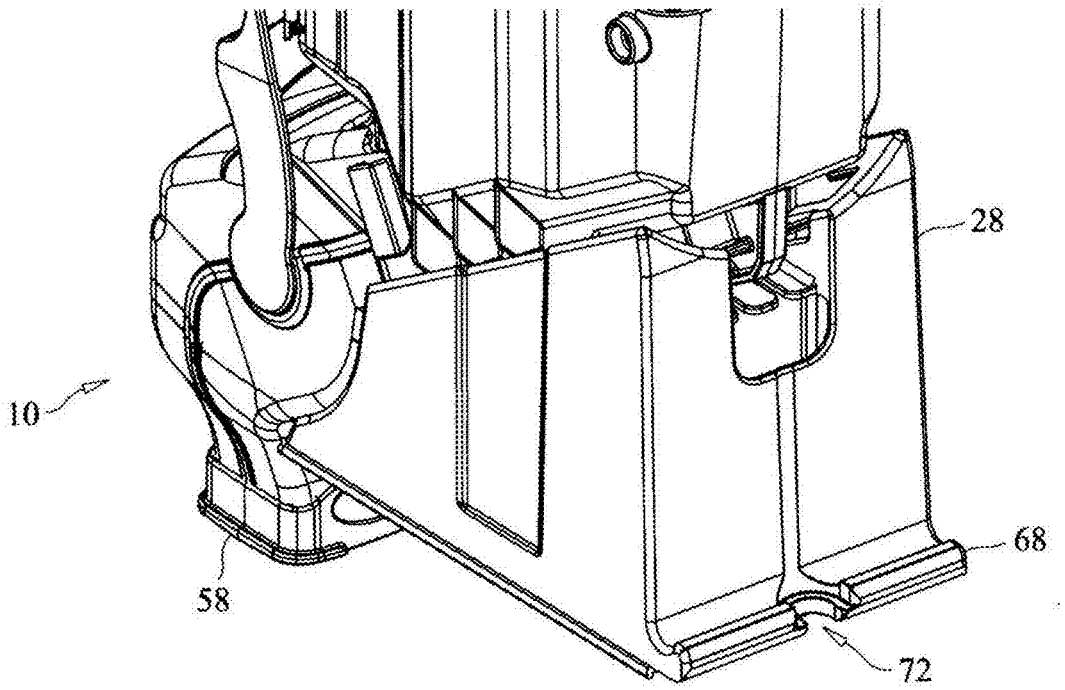
FIG. 16 is a partial rear view of a gravity-feed bin showing details of mounting features according to an embodiment of the present invention.
Figure 17:
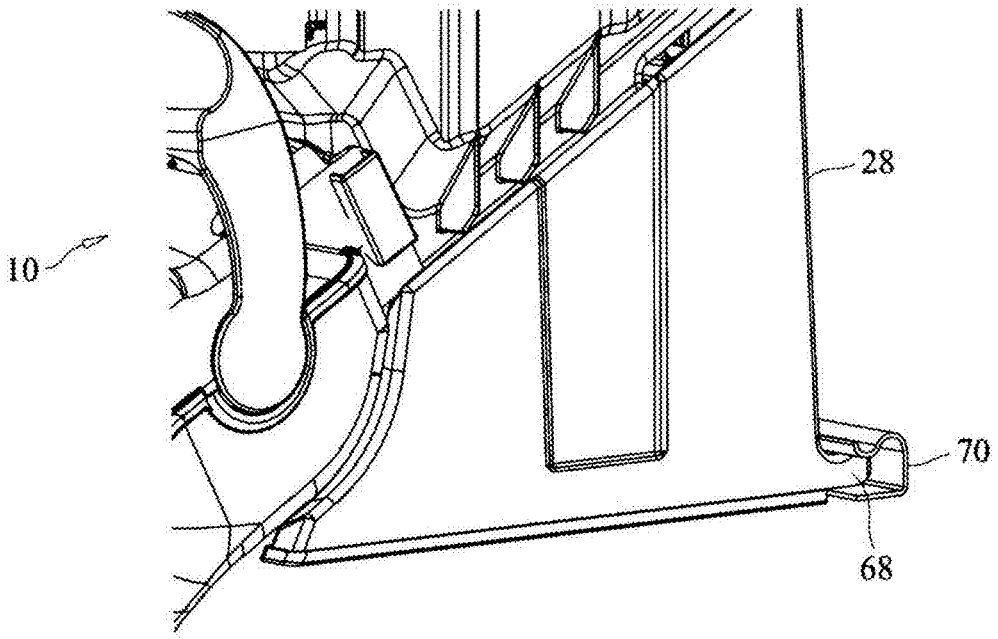
FIG. 17 is a partial side view of the gravity-feed bin of FIG. 16, showing the bin attached to a retainer according to an embodiment of the present invention.

With reference now to FIGS. 16 and 17, in some embodiments of the present invention base 28 may include retaining or fastening devices to selectably secure bin 10 to a display assembly such as a rack, shelf or table. For example, base 28 may have a flange 68 formed integral therewith or made separately and joined or coupled thereto. Flange 68 may be shaped to selectably engage a retainer strip 70, which may in turn be secured to the display assembly. When flange 68 engages retainer strip 70 the base 28 (and thus bin 10) is secured to deter undesired movement of the bin, particularly when a user is dispensing product from the bin. Similarly, base 28 may include one or more anchoring attachment tabs, recesses or apertures 72 through which a not-shown fastening device is inserted to selectably secure the base to the display assembly.

Figure 18:
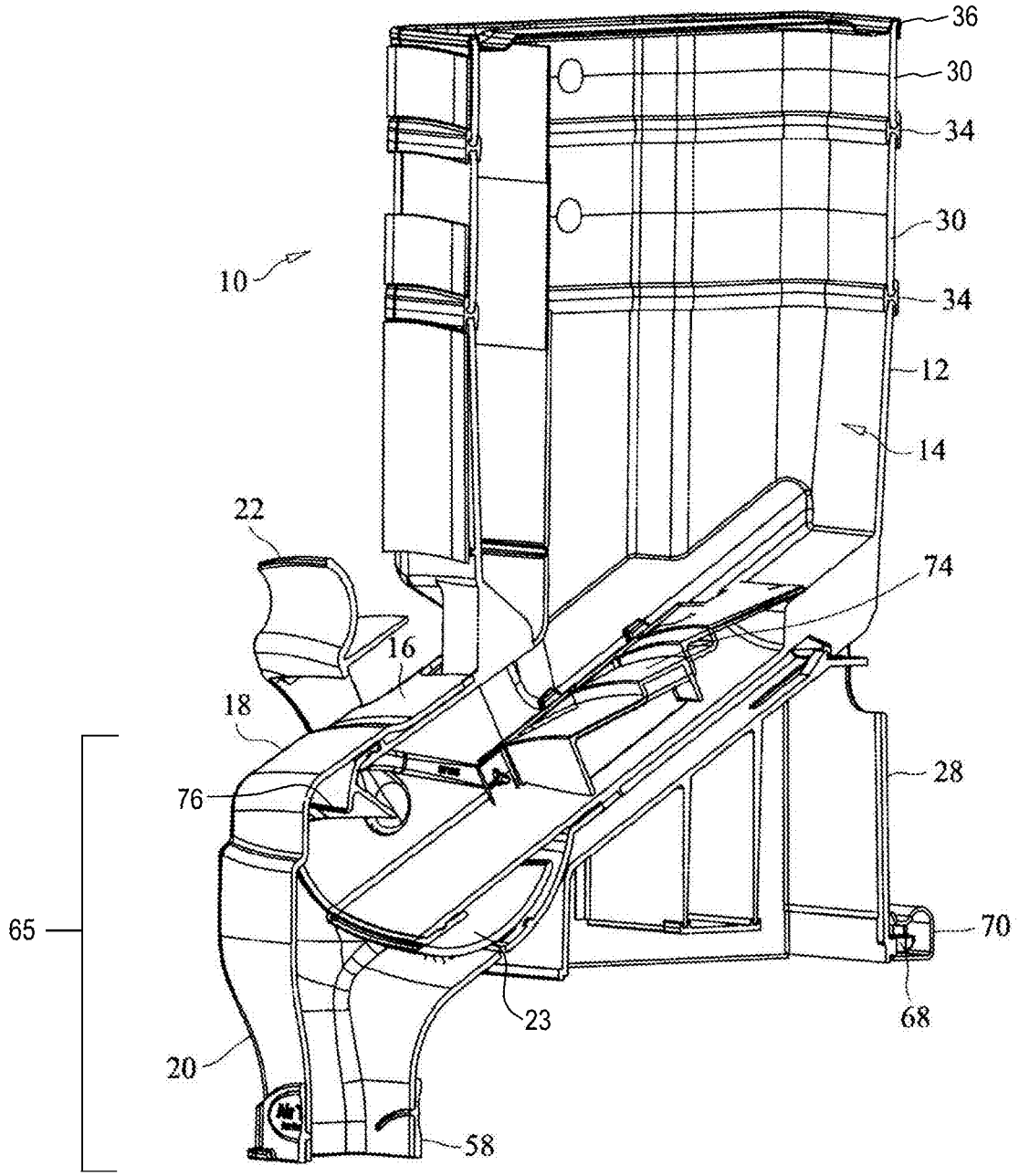
FIG. 18 is a cutaway view of a gravity-feed bin according to yet another embodiment of the present invention.

Some types of product stored in gravity-feed bin 10 may have various combinations of sizes, shapes and surface characteristics that render the product difficult to dispense. For example, components of product stored in the bin may have a tendency to exert tactile pressure upon each other such that the components bridge dispensing chute 16 or clump together. An agitating mechanism or other device may be employed to overcome this tendency. An agitator 74, shown in FIG. 18, is linked to and moved by handle 22. Movement of agitator 74 against the stored bulk material allows the bulk material, including difficult-to-dispense items, to flow under the force of gravity with the assistance of the agitator. Further details of agitators are provided in commonly-owned U.S. Pat. No. 7,178,697 to Brundick et al., the disclosure of which is herein incorporated by reference. For the sake of clarity FIG. 18 is shown with handle 22 in a "closed" position for dispensing product from bin 10, while gate 23 is shown in an "open" dispensing position.

In order to help maintain the freshness of product stored therein, the various embodiments of bin 10 are preferably configured such that a substantially air-tight seal of the interior portions of the bin is accomplished when product is not being placed into or dispensed from the bin. Accordingly, suitable seals, sealants and sealing elements may be placed at any openings, interfaces and joints of bin 10 as needed to achieve the substantially air-tight seal. As a non-limiting example, a gate seal 76 may be utilized to form a substantially air-tight seal about dispensing gate 23 when the dispensing gate is in the closed position.

While this invention has been shown and described with respect to a detailed embodiment thereof, it will be understood by those skilled in the art that changes in form and detail thereof may be made without departing from the scope of the claims of the invention.

What is claimed is:

1. An expandable gravity-feed bin, comprising:

a generally hollow main bin including:

a storage reservoir, and an open end having a first edged perimeter;

a first, generally hollow, extension section having second and third edged perimeters, the first extension section being selectably coupled to the open end of the main bin, the first edged perimeter having opposing first interior and first exterior surfaces, the second edged perimeter having opposing second interior and second exterior surfaces, and the third edged perimeter having opposing third interior and third exterior surfaces, the first extension section being in communication with the reservoir; and a resilient seal element disposed intermediate to the main bin and the first extension section, the seal element including a first receptacle, a second, opposing receptacle, and an interior and an exterior face, the first receptacle being configured to sealingly engage the first interior and the first exterior surfaces of the first edged perimeter and the second receptacle being configured to sealingly engage the second interior and the second exterior surfaces of the second edged perimeter, thereby providing a substantially air-tight seal between the main bin and the first extension section upon engagement, an upper portion of the interior face of the seal element being substantially in the same plane with an interior side of the first extension section, when assembled, the storage capacity of the gravity-feed bin being increased by the coupling of the first extension section to the main bin.

2. The expandable gravity-feed bin of claim 1, further comprising:

a slot formed in the main bin proximate the open end of the main bin; and a tab extending away from the first extension section, the tab being configured to selectably engage the slot of the main bin to selectably couple the first extension section to the main bin.

3. The expandable gravity-feed bin of claim 1, further including a sealing lid selectably coupled to the first extension section.

4. The expandable gravity-feed bin of claim 1, further comprising a base, the main bin being coupled to the base.

5. The expandable gravity-feed bin of claim 1, further comprising:

a first protrusion formed in the main bin;

a second protrusion formed in the first extension section; and a fastener, the fastener being configured to selectably engage the first and second protrusions, thereby selectably coupling the first extension section to the main bin.

6. The expandable gravity-feed bin of claim 5 wherein walls of each of the main bin and the first extension section include a recessed portion configured for recessed housing of the engaged fasteners such that an exterior surface of the fasteners does not protrude substantially past an exterior side of the walls.

7. The expandable gravity-feed bin of claim 1, further including at least one additional extension section, the at least one additional extension section being configured to be selectably coupled to the first extension section, and the first extension section and the at least one additional extension section forming a stacked arrangement.

8. The expandable gravity-feed bin of claim 7, further including a resilient seal element disposed intermediate to and adapted to sealingly engage the first extension section and the at least one additional extension section, the seal element providing a substantially air-tight seal between the first extension section and the at least one additional extension section.

9. The expandable gravity-feed bin of claim 7 wherein the at least one additional extension section comprises a plurality of extension sections, each of the plurality of additional extension sections being configured to be selectably coupled to an immediately adjacent extension section, a select one of the plurality of extension sections being configured to be selectably coupled to the first extension section, and the first extension section and the plurality of extension sections forming a stacked arrangement.

10. The expandable gravity-feed bin of claim 9, further including:

a plurality of seal elements, a seal element being intermediate each of the immediately adjacent extension sections; and a select resilient seal element being disposed intermediate to and adapted to sealingly engage the first extension section and the select one of the plurality of extension sections immediately adjacent to the first extension section, the plurality of seal elements providing a substantially air-tight seal between the immediately adjacent extension sections.

11. The expandable gravity-feed bin of claim 1, further including:

a generally hollow spout in communication with the reservoir; and a bag-grip element coupled to the spout.

12. The expandable gravity-feed bin of claim 11, further including a gate, the gate being configured to selectably close off the spout.

13. The expandable gravity-feed bin of claim 12, further comprising a handle coupled to the gate.

14. The expandable gravity-feed bin of claim 12, further including a biasing element coupled to the gate, the biasing element being configured to urge the gate to a position closing off the spout.

15. An expandable gravity-feed bin, comprising:

a generally hollow main bin including:

a storage reservoir, and an open end having a first edged perimeter;

a plurality of generally hollow extension sections, each of the plurality of extension sections having second and third edged perimeters and being configured to be selectably coupled to an immediately adjacent extension section, a select one of the plurality of extension sections being configured to be selectably coupled to the open end of the main bin, the first edged perimeter having opposing first interior and first exterior surfaces, the second edged perimeter having opposing second interior and second exterior surfaces, and the third edged perimeter having opposing third interior and third exterior surfaces, the plurality of extension sections being in communication with the reservoir, and the plurality of extension sections forming a stacked arrangement; and a plurality of resilient seal elements, each of the plurality of resilient seal elements including a first receptacle, a second, opposing receptacle, and an interior and an exterior face, a resilient seal element being disposed intermediate to each of the immediately adjacent extension sections, the second receptacle being configured to sealingly engage the second interior and the second exterior surfaces of the second edged perimeter and the first receptacle being configured to sealingly engage the third interior and the third exterior surfaces of the third edged perimeter of each of the immediately adjacent extension sections, thereby providing a substantially air-tight seal between the immediately adjacent extension sections upon engagement, and a select resilient seal element being disposed intermediate to the main bin and the select one of the plurality of extension sections, the first receptacle being configured to sealingly engage the first interior and the first exterior surfaces of the first edged perimeter and the second receptacle being configured to sealingly engage the second interior and the second exterior surfaces of the second edged perimeter of the select one of the plurality of extension sections, thereby providing a substantially air-tight seal between the main bin and the select one of the plurality of extension sections immediately adjacent to the main bin upon engagement, an upper portion of the interior face of each of the plurality of seal elements being substantially in the same plane with an interior side of the immediately adjacent extension section stacked above, when assembled, the storage capacity of the gravity-feed bin being increased by the coupling of the plurality of extension sections.

16. The expandable gravity-feed bin of claim 15, further comprising:

a first protrusion formed in the main bin and in each of the plurality of extension sections;

a second protrusion formed in each of the plurality of extension sections; and a fastener, the fastener being configured to selectably engage the first and second protrusions, thereby selectably coupling the plurality of extension sections to one another and to the main bin.

17. A method for selectably dispensing bulk materials, comprising the steps of:

obtaining a generally hollow main bin, the main bin including:

a storage reservoir, and an open end having a first edged perimeter;

obtaining a first, generally hollow, extension section having second and third edged perimeters, the first edged perimeter having opposing first interior and first exterior surfaces, the second edged perimeter having opposing second interior and second exterior surfaces, and the third edged perimeter having opposing third interior and third exterior surfaces;

obtaining a resilient seal element, the seal element including a first receptacle, a second, opposing receptacle, and an interior and an exterior face;

sealingly engaging first receptacle of the resilient seal element with the first interior and the first exterior surfaces of the first edged perimeter of the main bin;

sealingly engaging second receptacle the resilient seal element with the second interior and the second exterior surfaces of the second edged perimeter of the first extension section, whereby an upper portion of the interior face of the seal element is substantially in the same plane with an interior side of the first extension section, when assembled, whereby the resilient seal element is disposed intermediate to and provides a substantially air-tight seal between the main bin and the first extension section upon engagement;

selectably coupling the first, generally hollow, extension section to the open end of the main bin, the first extension section being in communication with the reservoir, and the storage capacity of the gravity-feed bin being increased by the coupling of the first extension section to the main bin, selectably dispensing the bulk materials from the reservoir.

18. The method of claim 17, further comprising the steps of:

forming a first protrusion in the main bin;

forming a second protrusion in the extension section; and coupling a fastener to the first and second protrusions, the fastener being configured to selectably engage the first and second protrusions, thereby selectably coupling the extension section to the main bin.

* * * * *